United States Patent [19]

Kemmner

[11] Patent Number: 4,608,957

[45] Date of Patent: Sep. 2, 1986

[54] AGGREGATE FOR SUPPLYING FUEL, PARTICULARLY FROM A SUPPLY CONTAINER TO AN INTERNAL COMBUSTION ENGINE OF A MOTOR VEHICLE

[75] Inventor: Ulrich Kemmner, Stuttgart, Fed. Rep. of Germany

[73] Assignee: Robert Bosch GmbH, Stuttgart, Fed. Rep. of Germany

[21] Appl. No.: 791,923

[22] Filed: Oct. 25, 1985

Related U.S. Application Data

[62] Division of Ser. No. 572,921, Jan. 20, 1984.

[30] Foreign Application Priority Data

Mar. 2, 1983 [DE] Fed. Rep. of Germany ..... 3307241

[51] Int. Cl.[4] ..... F02M 39/00

[52] U.S. Cl. ..... 123/467; 123/447; 92/94

[58] Field of Search ..... 123/467, 447, 457, 452, 123/463, 460, 383; 92/94

[56] References Cited

U.S. PATENT DOCUMENTS

| | | | |
|---|---|---|---|
| 3,021,792 | 2/1962 | Johnson | 92/94 |
| 4,161,964 | 7/1979 | Greiner | 123/447 |
| 4,205,637 | 6/1980 | Ito | 123/447 |
| 4,357,921 | 11/1982 | Ciaccio | 123/463 |

FOREIGN PATENT DOCUMENTS

| | | | |
|---|---|---|---|
| 2067663 | 7/1981 | United Kingdom | 123/383 |

*Primary Examiner*—Carl Stuart Miller

*Attorney, Agent, or Firm*—Michael J. Striker

[57] ABSTRACT

In an aggregate for supplying fuel from a fuel container to an internal combustion engine of a motor vehicle, a housing of a pressure wave-damping device, connected to an outlet of the pump of the aggregate, has an enclosed interior subdivided into two separate chambers by a diaphragm. The first chamber is connected to the outlet of the pump and has its own outlet whereas the second chamber has a damping spring accommodated therein. The housing is formed of two opposite shell portions positioned opposite to each other. A ring-shaped flange is provided, which is a portion of the housing, and which holds the peripheral edge of the diaphragm and embraces the rims of the shell portions of the housing.

5 Claims, 2 Drawing Figures

AGGREGATE FOR SUPPLYING FUEL, PARTICULARLY FROM A SUPPLY CONTAINER TO AN INTERNAL COMBUSTION ENGINE OF A MOTOR VEHICLE

This is a division of application Ser. No. 572,921 filed Jan. 20, 1984.

BACKGROUND OF THE INVENTION

The invention relates to an aggregate for supplying fuel, for example from a supply container filled with fuel to an internal combustion engine of a motor vehicle.

Aggregates of the type under consideration have been known in the art. Such an aggregate includes a damping arrangement, the housing of which has a sheet metal portion with a flanged rim in which a diaphragm of the damping arrangement is rolled-in. A rim of a sheet metal shell is folded about that flanged rim so as to form a completely enclosed housing, the interior of which is subdivided by the diaphragm into two chambers.

The pressure wave-damping arrangement formed as described above is made out of a relatively expensive material. The shaping of the housing portion, in which the inlet and outlet-forming supports are located, is, during the sheet metal-housing manufacturing, either significantly limited or must be produced from expensive part components and by costly manufacturing methods. Furthermore, rolling-in of the diaphragm in the flanged rim of the housing is costly and critical in regard to manufacturing.

Damping arrangements are normally required when pumps in the fuel-supplying aggregates are formed as impeller pumps, which generate a pulsating stream. These pulsations can, if they are not damped, be transmitted to a vehicle body and cause disturbing noises.

SUMMARY OF THE INVENTION

It is an object of the present to avoid disadvantages of prior art fuel-supplying aggregates.

It is a further object of the invention to provide an improved fuel-supplying aggregate, the advantage of which is that all the housing portions of the pressure wave-damping device are inexpensive, corrossion-resistant and can be manufactured in any desired shapes because of their deformability criterions. Thereby the size of the damping unit can be reduced without, however reducing the size of the diaphragm.

These and other objects of the invention are attained by an aggregate for supplying fuel, particularly from a supply tank to an internal combustion engine of a power vehicle, including an aggregate casing and a fuel feeding pump accommodated therein, and a pressure wave-damping device comprising a housing, said casing having a fuel-outlet opening which opens into said housing; a diaphragm, said housing enclosing an interior space, said diaphragm subdividing said space into a first chamber and a second chamber, said first chamber having an inlet connected to an outlet of said pump and an outlet; and pressure wave-damping, prestressed spring means positioned in said second chamber and supported on said diaphragm, said housing including a ring-shaped flange, said diaphragm having a peripheral portion held in said flange.

The flange may be rigidly connected to said diaphragam and form therewith a separate structural component.

The diaphragm may have a central portion which is provided with two reinforcement means arranged relative to the diaphragm opposite to each other.

One of the reinforcement means may be located in said first chamber and another of the reinforcement means may be located in said second chamber.

According to a further feature of the invention the housing of the pressure wave-damping device may further include a first tubular extension formed with a portion projecting into said first chamber and forming a first support, and a second elongated extension forming a second support and constituting said outlet of the first chamber, said first and second support forming stop means for said one reinforcement means which is movable under the action of the spring means.

According to still another feature of the invention said another reinforcement means may have a centering shoulder for supporting the damping spring means.

It is particularly advantageous that the aforementioned ring-shaped flange may include two ring-like collars extended substantially in a plane transversal to the diaphragm and positioned oppositely one to another in respect to the diaphragm.

Said housing may include a first housing shell and a second housing shell positioned oppositely to said first housing shell, one of said collars being adjusted to a diameter of said first housing shell and another of said collars being adjusted to a diameter of said second housing shell. The first housing shell and the second housing shell together with said flange constitute the housing of the pressure wave-damping device.

The collars of said flange may include portions which extend inwardly of said housing and over the rims of the housing shells.

The objects of the present invention can be also attained by an aggregate for supplying fuel, particularly from a supply tank to an internal combustion engine of a power vehicle, including an aggregate casing and a fuel feeding pump accommodated therein, and a pressure wave-damping device, the pressure wave-damping device comprising a housing, said casing having a fuel-outlet opening which opens into said housing; a diaphragm, said housing enclosing an interior space, said diaphragm subdividing said space into a first chamber and a second chamber, said first chamber having an inlet connected to an outlet of said pump and an outlet; and pressure wave damping prestressed spring means positioned in said second chamber and supported on said diaphragm said housing including a first housing shell and a second housing shell oppositely positioned to each other, said first and second housing shell being formed with flange-like peripheral rims opposing each other, said diaphragm being clamped between the peripheral rim of said first housing shell and the peripheral rim of the second housing shell.

It should be noted that the premanufactured component parts of the housing of the damping unit according to the invention can be assembled in a very simple fashion.

According to yet another feature of the invention the diaphragm may have a peripheral portion, the rim of the first housing shell having an annular bead, and the rim of the second housing shell having an annular groove adjusted to said bead, said peripheral portion of the diaphragm being held between said bead and said groove.

The rim of one of the housing shells may be formed with a centering collar embracing the rim of another of the housing shells and rigidly connected thereto. This centering collar of the rim of one housing shell may be connected to the rim of another housing shell by welding.

The housing of the damping device may further include a clamping means for clamping the rim of the first housing shell to the rim of the second housing shell.

The first housing shell, the second housing shell and said ring-shaped flange may be formed of synthetic plastic material and formed by injection molding.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
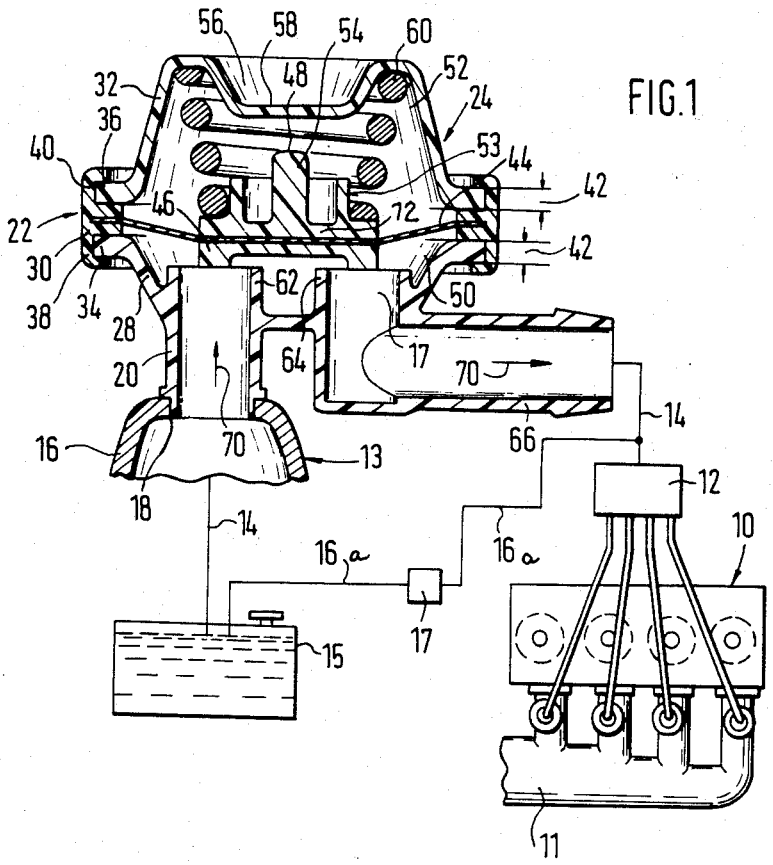
FIG. 1 illustrates a sectional view of the pressure wave-damping arrangement of the schematically shown aggregate for supplying fuel from a supply tank to an internal combustion engine.

FIG. 1 shows the pressure wave-damping device generally designated by reference numeral 24 in conjunction with a fuel container 15 and schematically illustrated internal combustion engine 10.

In the exemplified embodiment of the fuel-injection construction, the internal combustion engine 10 is supplied with air by a suction tube 11. Air of a predetermined quantity fed into the engine is added with a corresponding quantity of fuel via a fuel-dosing and fuel-distributing unit 12 as close as possible to engine inlet valves. The fuel-dosing unit 12 is supplied with fuel by a fuel-supplying aggregate 13 pumping fuel from the fuel container 15 via a conduit 14. The pressure of the fuel in conduit 14 is adjusted by means of a pressure-regulating valve 17 mounted in a reverse conduit 16. The fuel-supplying aggregate 13 is positioned in conduit 14 between fuel container 15 and internal combustion engine 10 and has a partially shown housing 16. Aggregate 13 includes in the conventional manner an electric drive motor and a fuel-pumping pump which are accommodated in casing 16. For the sake of simplicity the known part components of fuel-supplying aggregate 13 are not shown herein.

Casing 16 has a bore 18 at the outlet side thereof, at which a pump commonly known and not shown herein is located. An outlet or pressure pipe 20, which is a portion of housing 22 of the pressure wave-damping device 24, is inserted at the end thereof into bore 18. Casing 16 can be formed of synthetic plastic material and can be welded to housing 22 in the region of bore 18. Housing 22 encloses the components of the pressure wave-damping device. This housing is constructed of three portions. The first housing portion is a lower housing shell 28 which includes the tubular extension or pressure pipe 20. A second housing portion is an upper housing shell 32 and the third housing portion is a ring-like flange 30. Each housing shell 28, 32 has a respective flange-like rim 34, 36. Rims 34 and 36 are surrounded by ring-shaped collars 38 and 40 of the flange 30.

The flange-like rims 34 and 36 of housing shells 28 and 32 lie against the front faces of the respective inwardly directed portions of the ring-like flange 30. The height of each ring-shaped collar 38 or 40 is greater than the thickness 42 of each rim 34 or 36 so that the overlapping portions of ring-shaped collars 38 and 40 can be bent inwardly so that housing shells 38 and 32 can be rigidly connected to the flange 30. An edge or peripheral portion of a diaphragm 44 is integrally molded between the inwardly extended portions of flange 30 which in turn is injection-molded from a synthetic thermoplastic material. The central portion of the diaphragm 44 is provided with reinforcement means 46 and 48 positioned against each other relative to the diaphragm 44. The latter subdivides the interior of housing 22 into two chambers 50 and 52. The lower reinforcement means 46 is located in chamber 50 and is formed as a plate or disc, the bottom of which lies against the diaphragm. The upper reinforcement means 48, which is located in the second chamber 52, is superimposed on the bottom surface of lower reinforcement means 46. The upper reinforcement means 48 has a disc-like bottom 72, provided with an annular centering shoulder 53, and a central projection 54 which extends from bottom 72 towards a drawn-in portion or depression 56 formed in upper housing shell 32. Projection 54 cooperates with a flat wall 58 of the drawn-in portion 56 in the direction of limiting of the movement. A conically-shaped damping spring 60, which is a compression spring, is arranged in the second chamber 52. The end of the spring of the smaller diameter is supported in its central position on the ring-shaped centering shoulder 53 of centering disc or reinforcement means 48 whereas the opposite end of spring 60, of the greater diameter, is supported and centered by the drawn-in portion 56 of housing shell 32.

Both reinforcement means 46 and 48 are practically integrally connected to each other as a one-piece by means of perforations formed in the central region of diaphragm 44. The peripheral portion of diaphragm 44 held in the flange 30 is also provided with perforations so that a reliable fixing of the diaphragm in the ring-shaped flange 30 is warranted.

Tubular extension 20 has a first upright supporting portion 62 which opens into first chamber 50. A second upright supporting portion 64 of tubular extension 20, also extending into chamber 50, is formed which an elongated portion 66 which constitutes an outlet conduit, the latter being connected to conduit 14 which leads to internal combustion engine 10. Supporting portions 62 and 64 form a stop means for reinforcement disc-shaped means 46 and thereby limit the path of the movement of the diaphragm 44 in the direction of action of the force of damping spring 60, which is a compression spring as has been mentioned above. The movement of the diaphragm against the direction of action of the force of spring 60 is limited by projection 54 striking against the flat wall 58 of the drawn-in portion 56 of housing shell 32.

As mentioned above housing 22 of pressure wave-damping device 24 is comprised of three portions, first housing shell 28, the extention 20 of which has an inlet support 62 and outlet support 64, second housing shell 32, and ring-shaped flange 30 connecting shells 28 and 32 to each other. The ring-shaped flange 30 is premanufactured so that, before assembling of the housing 22, this flange is provided with diaphragm 44, on which reinforcement means 46 and 48 have been preliminarily arranged. The rim of diaphragm 44, which can be formed, for example of fluorine caoutchouc or nitrile caoutchouc, is molded into flange 30 during the manufacturing. The material of the diaphragm can be maintained for a short period of time under the manufacturing temperature of approximately 170° C. The above described housing portions 28 and 32 are manufactured of a synthetic thermoplastic material so that, after assembling the housing 22, the circular portions of the ring shaped collars 38, 40, each extending over the thickness 42 of the respective flange-like rim 34, 36, can be formed as shown in FIG. 1. Thereby a reliable connection of the housing portions 28, positioned one under the other can be attained.

Figure 2:
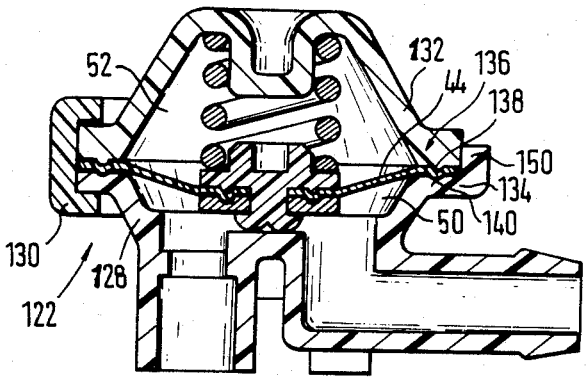
FIG. 2 shows a sectional view of the pressure wave-damping arrangement according to a modified embodiment of the invention.

A modified embodiment of the pressure wave-damping device denoted as 122 is shown in FIG. 2. In this embodiment diaphragm 44, also provided with the reinforcement means at two opposite sides thereof, is clamped directly between flange-like rims 134 and 136 of housing shells 128, 132. The necessary clamping action is obtained by means of an annular bead or projection 138 formed on the flange-like rim 136 of one housing shell 132, which bead cooperates with a circular groove formed in the flange-like rim 134 of another housing shell 128. Due to such a structure a sealing between chambers 50 and 52 is warranted. A similar bead and a groove receiving that bead may be formed on the diaghram and the reinforcement means as shown in FIG. 2. The connection of housing shells 128 and 132 to each other can be obtained, preferably by welding of rims 134 and 136 to each other; the utilization of the welding may be advantageous when the rim 134 is formed with a centering collar 150 which can be welded to rim 136 as seen on the right-hand side of FIG. 2.

It is also possible that the clamping of the rim of one shell against the rim of another shell be utilized in place of welding as shown in the left-hand side of FIG. 2. Such a clamping can be carried out either by a number of bending clips or by a clamping ring 130.

In operation of the aggregate fuel is sucked from tank 15 via conduit 14 and is pressed through pressure tube 20 into first chamber 50 of pressure wave-clamping device 24. The force of pressure waves lifts diaphragm 44 from the ends of supports 62 and 64 against the force of damping spring 60 and moves it in the direction of flat surface 58 of second housing shell 32. In the instance that the force of pressure waves exceeds a predetermined value so that the diaphragm 44 could be potentially damaged, the projection 54 would strike against flat surface 58. In the rest position shown in the drawing, the diaphragm 44 with its reinforcement means is supported on supports 62 and 64. The fuel to be supplied to the internal combustion engine flows into first chamber 50 of device 24 in the direction of arrow 70 and leaves that chamber through outlet conduit 66, from which fuel flows through conduit 14 to internal combustion engine 10.

It will be understood that each of the elements described above, or two or more together, may also find a useful application in other types of aggregates for supplying fuel from supply tanks to internal combustion engines differing from the types described above.

While the invention has been illustrated and described as embodied in an aggregate for fuel supply, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an aggregate for supplying fuel, particularly from a supply tank to an internal combustion engine of a motor vehicle, including an aggregate casing and a fuel feeding pump accommodated therein, and a pressure wave-clamping device, the pressure wave-clamping device comprising a housing, said casing having a fuel-outlet opening which opens into said housing; a diaphragm; said housing enclosing an interior space, said diaphragm subdividing said space into a first chamber and a second chamber, said first chamber having an inlet connected to an outlet of said pump, and an outlet; and pressure wave damping prestressed spring means positioned in said second chamber and supported on said diaphragm, said housing including a first housing shell and a second housing shell oppositely positioned to each other, said first and second housing shell being formed with flange-like peripheral rims opposing each other, said diaphragm being clamped between the peripheral rim of said first housing shell and the peripheral rim of the second housing shell, said diagragm having a central portion which is provided with two reinforcement means arranged opposite to each other relative to said diaphragm, one of said reinforcement means being located in said first chamber and another of said reinforcement means being located in said second chamber, said another reinforcement means having a centering shoulder for supporting said damping spring means, said diaphragm having an edge portion, the rim of the first housing shell having an annular bead, and the rim of the second housing shell having an annular groove adjusted to said bead, said edge portion of the diaphragm being held between said bead and said groove.

2. The aggregate as defined in claim 1, wherein the rim of the first housing shell is formed with a centering collar embracing the rim of the second housing shell and rigidly connected thereto.

3. The aggregate as defined in claim 2, wherein said centering collar of the rim of the first housing shell is connected to the rim of the second housing shell by welding.

4. The aggregate as defined in claim 1, said housing further including a clamping means for clamping the rim of the first housing shell to the rim of the second housing shell.

5. In an aggregate for supplying fuel, particularly from a supply tank to an internal combustion engine of a motor vehicle, including an aggregate casing and a fuel feeding pump accommodated therein, and a pressure wave-clamping device, the pressure wave-clamping device comprising a housing, said casing having a fuel-outlet opening which opens into said housing; a diaphragm; said housing enclosing an interior space, said diaphragm subdividing said space into a first chamber and a second chamber, said first chamber having an inlet connected to an outlet of said pump, and an outlet; and pressure wave damping prestressed spring means positioned in said second chamber and supported on said diaphragm, said housing including a first housing shell and a second housing shell oppositely positioned to each other, said first and second housing shell being formed with flange-like peripheral rims opposing each other, said diaphragm being clamped between the peripheral rim of said first housing shell and the peripheral rim of the second housing shell, said diaphragm having an edge portion, the rim of the first housing shell having an annular bead, and the rim of the second housing shell having an annular groove adjusted to said bead, said edge portion of the diaphragm being held between said bead and said groove.

* * * * *